US005376863A

United States Patent [19]

Kim et al.

[11] Patent Number: 5,376,863

[45] Date of Patent: Dec. 27, 1994

[54] ELASTIC SUPPORTING MEMBER FOR SHADOW MASK FRAME

[75] Inventors: Sungug Kim; Youcheol Han, both of Kyunggi, Rep. of Korea

[73] Assignee: Samsung Electron Devices Co., Ltd., Kyunggi, Rep. of Korea

[21] Appl. No.: 967,212

[22] Filed: Oct. 27, 1992

[30] Foreign Application Priority Data

Nov. 22, 1991 [KR] Rep. of Korea ..... 91-20149[U]

[51] Int. Cl.[5] ..... H01J 29/07

[52] U.S. Cl. ..... 313/404; 313/405; 313/406; 313/407

[58] Field of Search ..... 313/404, 402, 405, 407, 313/406; 217/169, 169.1; 24/489, 499, 509, 616; 248/316.1, 316.5, 917, 222.1, 221.3, 221.4

[56] References Cited

U.S. PATENT DOCUMENTS

| | | | |
|---|---|---|---|
| 2,063,924 | 12/1936 | Hanko | 248/316.5 X |
| 2,493,305 | 1/1950 | McKinney | 24/509 |
| 3,894,260 | 7/1975 | Sedivy | 313/405 |
| 3,921,024 | 11/1975 | Bakker et al. | 313/404 |
| 3,935,496 | 1/1976 | Gijrath | 313/402 |
| 3,986,071 | 10/1976 | Groot | 313/404 |
| 4,670,687 | 6/1987 | Gijrath et al. | 313/404 |
| 4,722,120 | 2/1988 | Lu | 24/499 X |
| 4,827,180 | 5/1990 | Sone et al. | 313/404 |
| 4,950,941 | 8/1990 | Ragland, Jr. | 313/404 |
| 4,950,943 | 8/1990 | Ito | 313/404 |
| 4,959,892 | 10/1990 | Wang | 24/489 X |

FOREIGN PATENT DOCUMENTS 0288831 2/1988 European Pat. Off. .

OTHER PUBLICATIONS

"An Angle on the Corners, The new Approach in Shadow-Mask Suspension Systems," Admiraal et al., *Electronic Components and Applications,* 1988 vol. 8, No. 4, pp. 215–221.

*Primary Examiner*—Donald J. Yusko
*Assistant Examiner*—Ashok Patel
*Attorney, Agent, or Firm*—Christie, Parker & Hale

[57] ABSTRACT

The present elastic supporting member for use in a shadow mask frame has a fixing plate attached to the shadow mask frame; a supporting plate suspended from a conventional stud pin; a spring member interposed between the fixing plate and supporting plate; a pin by which a bracket of the fixing plate and the bracket of the supporting plate are hinged on each other; and stoppers to define the disposing distance between the fixing and supporting plates.

6 Claims, 3 Drawing Sheets

ELASTIC SUPPORTING MEMBER FOR SHADOW MASK FRAME

FIELD OF THE INVENTION

The present invention relates to a supporting device of a shadow mask frame of a color cathode ray tube and more in particular to an elastic supporting member which is disposed at the inside corner of a face plate of a color cathode ray tube and supports the edge of the shadow mask frame.

BACKGROUND OF THE INVENTION

A color cathode ray tube of shadow mask type is formed such that electron beams emitted from an electron gun having R red, G green, B blue beam holes pass through apertures of the shadow mask to land on R, G, B phosphorescent layers.

However, a part of the electron beams pass through the apertures of the shadow mask but a part of them strike the shadow mask to heat its face, so that the thermal expansion occurs in the face of the shadow mask to dome out. Such doming results in the changing of the aperture position against the electron beam, so that such doming should be corrected.

A conventional method for solving the doming of the shadow mask is such that a bimetal spring which is called a hook spring is interposed between a stud pin installed at a predetermined position of the inner surface of a face panel and the shadow mask frame suspended from it to compensate for the changing of the aperture position caused by the shadow mask doming.

The bimetal spring is installed at the middle part or the edge of the shadow mask frame. The structure of the bimetal spring's installation at the edge of the shadow mask frame has an advantage such that the bimetal spring holds back the free vibrations of the shadow mask frame.

The method such as described above is disclosed in the U.S. Pat. Nos. 3,894,260, 3,935,496, 3,921,024 and 3,986,071. A suspending system of such inventions has a clamping member attached to the edge of the shadow mask frame in common. The clamping member is provided with a pair of tension arms and bimetal springs to be welded to a predetermined position of the shadow mask frame or connected to the shadow mask frame by a locking member.

Such a suspending system results in an increased number of elements and its complex structure results in the difficultly attaching and detaching. Thus, as is the case during the manufacturing process of the color cathode ray tube, the attaching and detaching operation of the face plate and shadow mask frame is repeated many times, the elements can be easily deformed.

In particular, assembly of the structure disclosed in U.S. Pat. No. 3,894,260 can not be formed by using manufacturing equipment of the conventional color cathode ray tube since stud members for supporting the one end of the bimetal spring should be installed at all edges.

Also, in the case of the face plates disclosed in U.S. Pat. Nos. 3,921,024 and 3,935,496, because such face plate have a recess at all edges where the bimetal spring can be set, a metal mold for a new face plate should be used.

U.S. Pat. No. 3,986,071 has a disadvantage such that, whereas a pair of stud pins are installed at the edge of the face plate to support the both ends of the bimetal spring, the system of such method results in an unstable suspending state of the bimetal spring.

The simplest structure of the bimetal spring supporting the corner part of the shadow mask frame is described in FIG. 3. The bimetal spring 2 shown in FIG. 3 has a fixing plate 8 attached to the edge of the rigid frame 6 supporting the shadow mask and a supporting plate 10 of which one end is united to the fixing plate 8.

The supporting plate 10 has a hole 16 which is penetrated and supported by the stud pin 14 of the face plate 12. The above suspending system has disadvantage such that, during the attaching and detaching operation which is repeated many times in the manufacturing process, the suspending system is folded in the direction of arrow X, so that the elastic coefficient of the supporting plate 10 is easily changed.

In addition, when the frame 6 is shaken by the impact applied from the outside according as the weight of the frame 6 is connected on the supporting plate 10, the supporting plate 10 twists against the fixing plate in the direction of arrow Y.

SUMMARY OF THE INVENTION

An object of the present invention is to provide an elastic supporting member for a shadow mask frame in which the elastic coefficient of a bimetal spring supporting the shadow mask frame is not changed even though, during the manufacturing process of a color cathode ray tube, the shadow mask frame is attached and detached many times from a face plate.

To achieve the above object, the present invention proposes the elastic supporting member having

- a fixing plate attached to a conventional shadow mask frame;
- a supporting plate suspended from a conventional stud pin;
- a spring member interposed between the fixing plate and the supporting plate;
- a pin by which a bracket of the fixing plate and the bracket of the supporting plate are hinged on each other; and
- a stopper defining the distance between the fixing plate and the supporting plate.

BRIEF DESCRIPTION OF THE DRAWINGS

Further objects and other advantages of the present invention will be apparent from the preferred embodiment of the present invention in connection with the following drawings, in which.

DETAILED DESCRIPTION OF A PREFERRED EMBODIMENT

Figure 1:
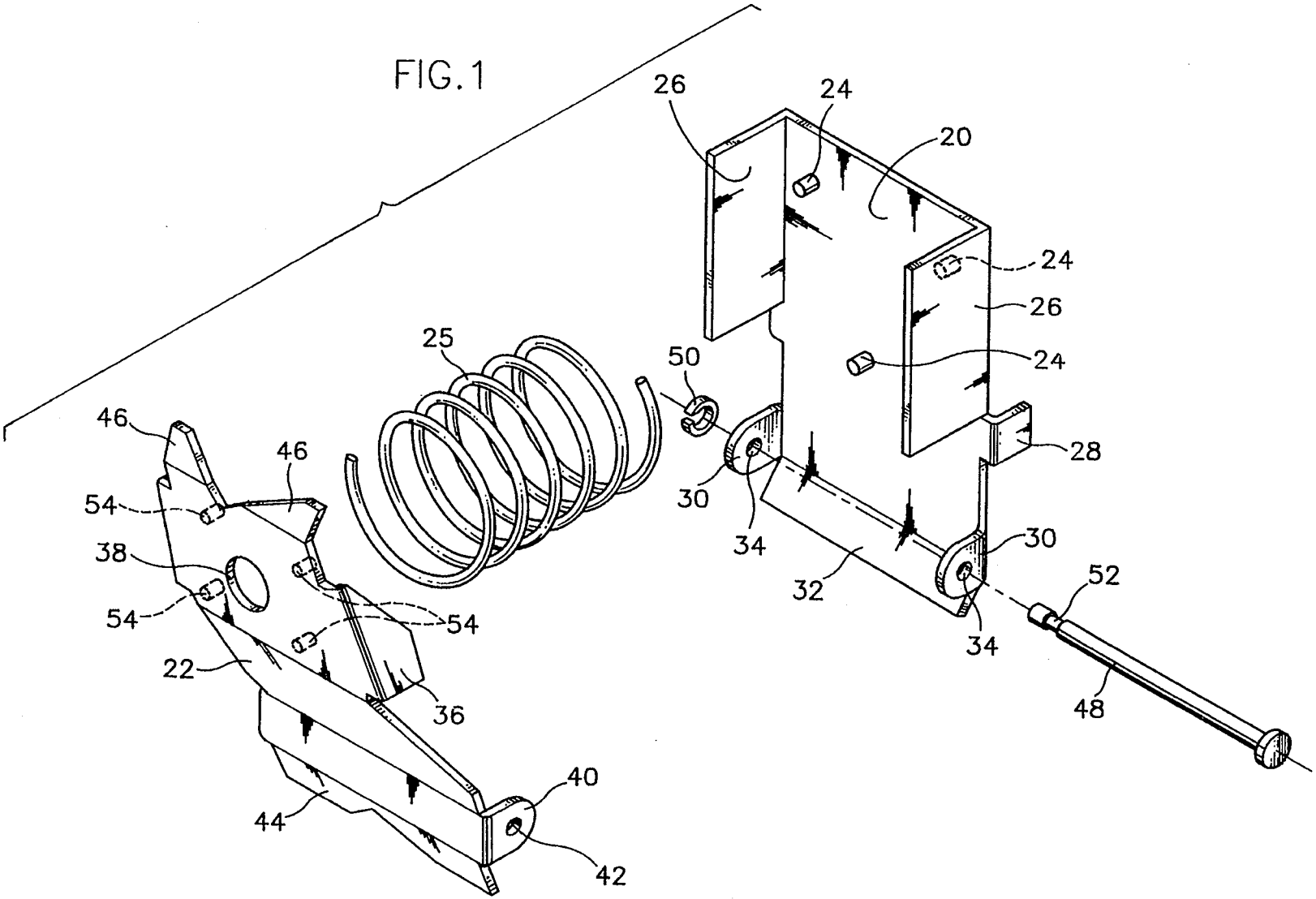
FIG. 1 is an exploded perspective view of a main part of the invention.

An elastic supporting member of the present invention, as shown in FIG. 1, has a fixing plate 20 and a supporting plate 22. A plurality of pins 24 to determine the position are arranged on the face of the fixing plate 20 so that a spring member 25 can be installed.

In both side directions of the face on which the pins to determine the position are installed, outer flanges 26 are formed opposing to each other and conforming to the projecting direction of the pins.

Neighboring the outer flanges 26, a ratchet 28 is formed by being bent in the direction opposite to the outer flanges 26. Opposing to the ratchet 28, a pair of brackets 30 are formed by being bent parallel to the projecting direction of the outer flanges 26. Both brackets 30 have axial holes. A stopper is formed between the brackets 30.

Corresponding to the above fixing plate 20, a supporting plate 22 has the following structure.

The supporting plate 22 has a pair of inner flanges 36 which are united with the inside of the outer flanges 26. A hole 38 is formed on the face defining a relation between the inner flanges 36.

Corresponding to the bracket 30 of the fixing plate in which the axial hole 34 is formed and the stopper 32, the bracket 42 of the supporting plate 22 in which the axial hole 42 is formed and the stopper 44 are provided. A pair of guides 46 are formed in the fork shape on the remote and opposing position from the stopper 44.

The bracket 30 of the fixing plate 20 and that of the supporting plate are hinged on each other by a pin 48. A circular groove 52 is provided near the one end of the pin 48 to be fastened by a lock 50.

Figure 2:
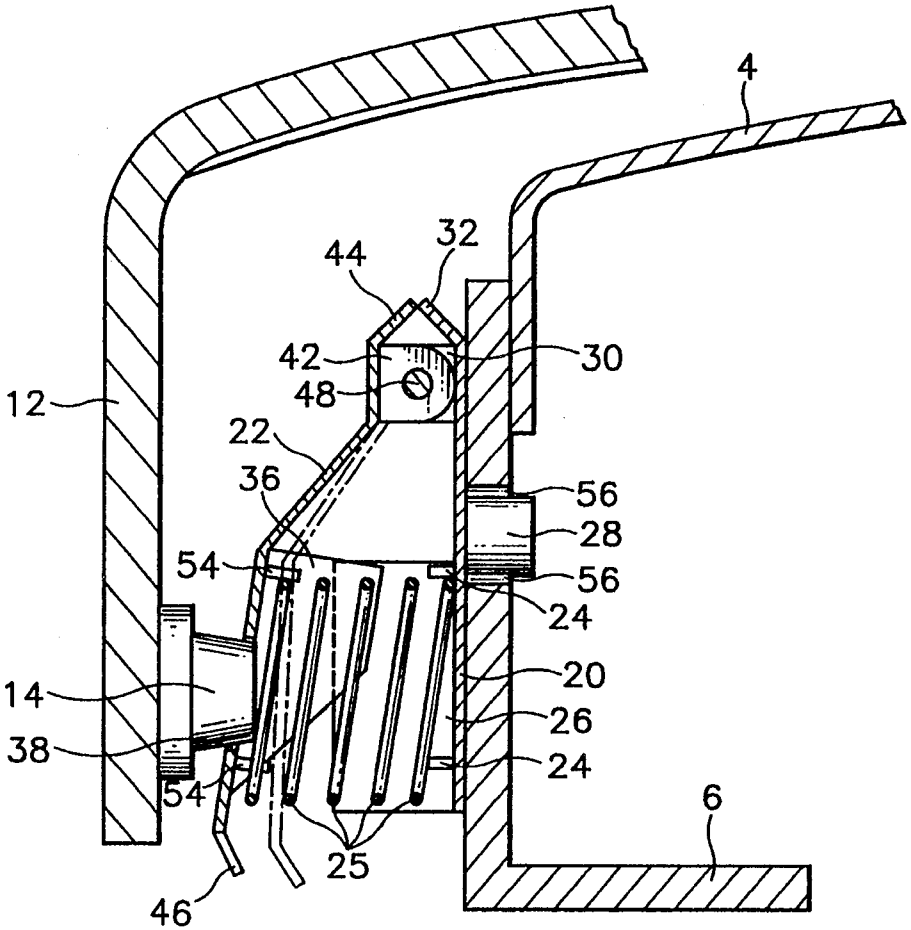
FIG. 2 is a partial sectional side view of the installing example of the present invention at the inside of a face plate.
Figure 3:
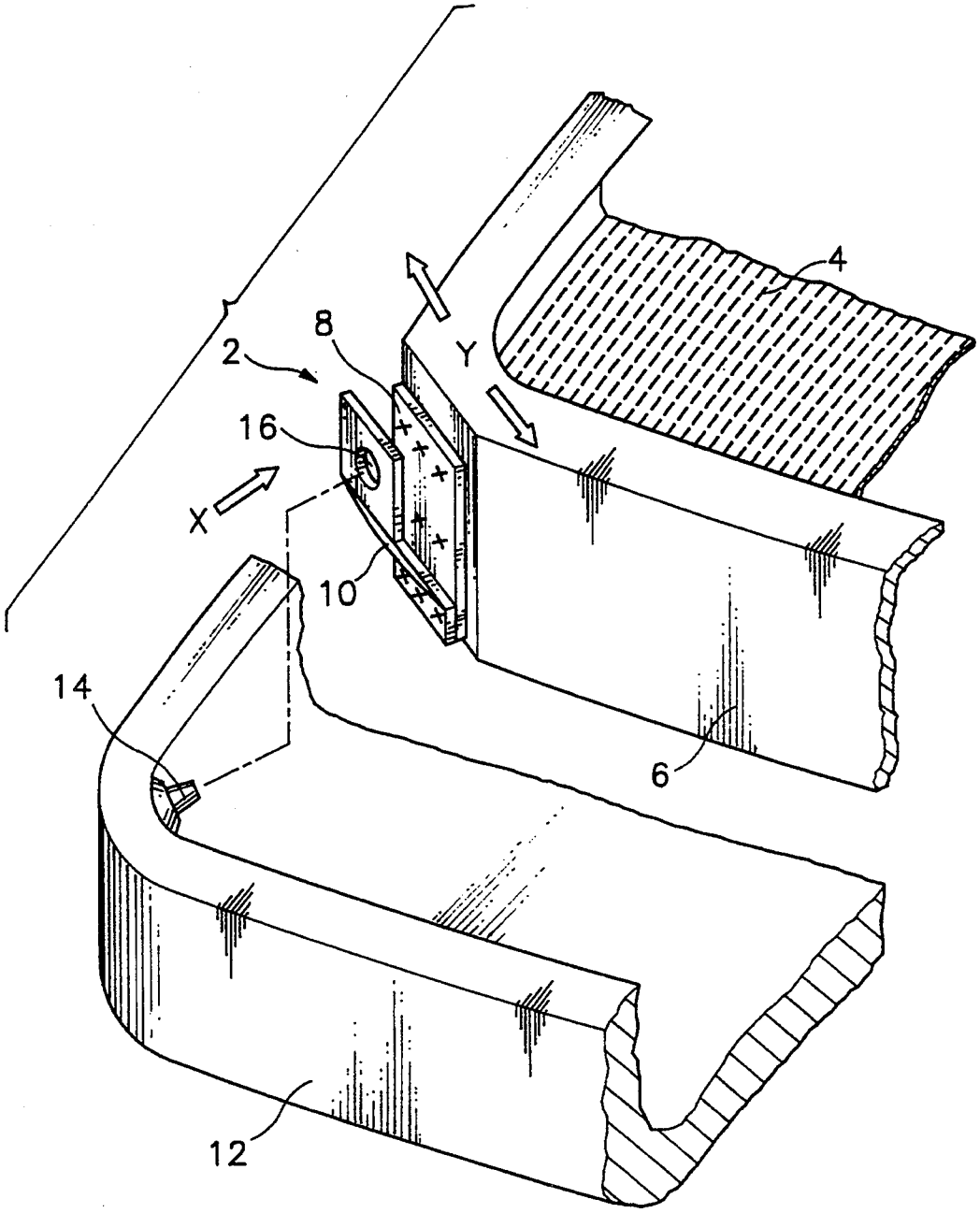
FIG.3(Prior Art)
FIG. 3 is a partial perspective view of a conventional bimetal spring supporting the corner of a shadow mask frame.

As shown in FIG. 2, a plurality of pins 54 to determine the position of the spring member 25 are arranged on the face of the supporting plate 22. Thus, the spring member 25 can be installed between the fixing plate 20 and the supporting plate 22 without being welded to the outside.

The elastic force of the spring member 25 is applied between the fixing plate 20 and the supporting plate 22 of which one sides are hinged by the pin 48 as described above. Thus, the force is received by the fixing plate 20 and the supporting plate 22 in the direction of becoming far off from each other.

However, because the elastic force of the spring member 25 is not applied any longer at the position of contacting the stopper 32 of the fixing plate 20 to that of the supporting plate 22, the distance between the fixing plate 20 and the supporting plate 22, is uniformly maintained.

In this embodiment, there will be not limited within the fact that the spring member 25 is a coil spring.

For example, even if a torsion spring is installed on the periphery of the pin 48, the same operation can be performed.

The fixing plate of FIG. 2 is attached to a frame 6 supporting the shadow mask 4 by welding.

At that time, the ratchet 28 of the fixing plate 20 is inserted in a slot 56 formed at the position corresponding to the frame 6 to be rigidly attached without any shake.

Next, at the same time when the coil spring 25 is interposed between the pins 24 and the pins 54 to determine the position of spring member 25 the inner flange 36 of the supporting plate 22 is positioned to face the outer flange 26 of the fixing plate 20 to be contacted to each other, and the bracket 30 of the fixing plate and the bracket 42 of the supporting plate 22 are conformed to each other and hinged by the pin thereby completing the assembly.

By contacting and supporting the inner flange 36 of the supporting plate 22 to the outer flange 26 of the fixing plate 20, when the external impact is applied, the supporting plate 22 is not twisted against the fixing plate 20.

The supporting plate 22 suspended from the stud pin 14 of the face plate 12 can be folded along a dotted line, as described in FIG. 2, against the spring member 25 so as to easily perform attaching and detaching.

When the frame is assembled at the inside of the face plate 12, the guide of fork shape 46 of the supporting plate 22 is provisionally united with the stud pin 14 of the face plate 12 so as to determine the assembling position of the frame 6 and at the same time, guide the hole 38 of the supporting plate 22 thereby easily agreeing to the stud pin 14.

In case that the material of the shadow mask 4 is invar, there is no need to the structure made of bimetal.

However, in case that the shadow mask is made of a conventional silicon steel, the supporting plate 22 should be made of bimetal to correct the doming of the shadow mask.

As described above, according as an elastic supporting member of the present invention has the structure such that the fixing plate attached to the shadow mask frame and the supporting plate suspended from the stud pin of the face plate are hinged, during the manufacturing process of the color cathode ray tube, the attaching and detaching operation of the shadow mask frame which is repeated many times can be easily performed and at the same time, during the attaching and detaching process, the destroying and deforming of supporting members do not occur.

What is claimed is:

1. A shadow mask frame, face plate and elastic supporting member assembly comprising:

a fixing plate attached to the shadow mask frame;

a supporting plate suspended from a stud pin of the face plate;

a pin by which a bracket of the fixing plate and a bracket of the supporting plate are hinged on each other;

a spring member interposed between the fixing plate and the supporting plate for urging the supporting plate away from the fixing plate; and means for limiting a distance between the fixing plate and the supporting plate urged relatively away from each other by the spring member.

2. The assembly as claimed in claim 1, wherein the spring member is a coil spring.

3. The assembly as claimed in claim 1, wherein the supporting plate is made of bimetal.

4. The assembly as claimed in claim 1, wherein the fixing and supporting plates each further comprise a pair of flanges disposed in opposing locations for contacting each other to provide support for the supporting plate against twisting.

5. The assembly as claimed in claim 1, wherein the supporting plate has a guide of fork shape.

6. The assembly as claimed in claim 1, wherein the fixing plate and the supporting plate have a plurality of pins for determining a position of the spring member.

* * * * *